United States Patent [19]

Rosenthal et al.

[11] 4,035,542

[45] July 12, 1977

[54] FLAME RETARDANT FIBER BLEND CONTAINING FIBERS WHICH IF PRESENT APART FROM THE ADMIXTURE UNDERGO BURNING

[75] Inventors: Arnold J. Rosenthal, Whippany; Alex S. Forschirm, Lake Hiawatha, both of N.J.; Bruce P. Barnes, Charlotte, N.C.

[73] Assignee: Celanese Corporation, New York, N.Y.

[21] Appl. No.: 470,420

[22] Filed: May 16, 1974

[51] Int. Cl.[2] ..... D03D 25/00

[52] U.S. Cl. ..... 428/224; 8/115.7; 260/7; 260/9; 260/14; 260/16; 260/75 H; 260/47 C; 260/823; 260/841; 260/843; 260/844; 260/8 60; 260/873; 260/DIG. 24

[58] Field of Search ..... 260/9, 47, 47 C, 75 H, 260/860; 161/89, 70; 428/224

[56] References Cited

U.S. PATENT DOCUMENTS

| | | | |
|---|---|---|---|
| 3,763,644 | 10/1973 | Jackson et al. | 260/75 |
| 3,794,617 | 2/1974 | Mains | 260/47 |
| 3,824,213 | 7/1974 | Stackman | 260/47 C |
| 3,833,685 | 9/1974 | Wambach | 260/860 |
| 3,839,140 | 10/1974 | Tyler et al. | 260/75 |
| 3,874,157 | 4/1975 | Knopka | 260/860 |
| 3,883,611 | 5/1975 | Nelson | 260/860 |

*Primary Examiner*—Edward M. Woodberry

[57] ABSTRACT

An assemblage of fibers is provided which exhibits highly satisfactory flame retardant characteristics in spite of the fact that discrete fibers are included within the admixture which would normally burn when exposed to flame. Included in intimate physical admixture with the fibers which would normally undergo combustion are discrete additive fibers consisting primarily of a chlorinated and/or brominated aromatic polymer having the inherent ability to render the admixture as a whole non-burning when subjected to the flame. Particularly preferred additive fibers are formed primarily of an aromatic polyester formed from the reaction of tetrabromobisphenol A, isophthalic acid, and terephthalic acid or the esterforming derivatives thereof. Also, in a particularly preferred embodiment a minor concentration of an oxide of antimony (e.g. antimony trioxide or antimony pentoxide) is intimately dispersed throughout the additive fibers. Flame retardant fiber blends readily may be formed without a diminution of the textile properties thereof, e.g. hand and aesthetic appeal.

56 Claims, No Drawings

FLAME RETARDANT FIBER BLEND CONTAINING FIBERS WHICH IF PRESENT APART FROM THE ADMIXTURE UNDERGO BURNING

BACKGROUND OF THE INVENTION

Interest in flame retardant chemicals steadily has increased over the past decade spurred in part by a recognition of the serious hazards fires pose to property and life. New and stricter fire safety standards are being proposed by both governmental and non-governmental sources. The National Fire Protection Association estimates that in 1970 more than 2.5 million fires caused 2.6 billion in direct property losses and another $7.8 billion in indirect losses. Nearly 2 million people are involved in fires each year, and of these about 75,000 are hospitalized. Fires associated with flammable fabrics alone are estimated to cause 200,000 to 300,000 injuries each year. Associated medical costs are staggering, running well into the hundreds of millions of dollars. In 1970 it is estimated that 12,200 people died as a result of fires.

Heretofore a variety of approaches have been proposed for attempting to deal with the fire hazard posed by flammable fibers, e.g. blends of cotton fibers with polyester fibers. Generally these approaches have involved the chemical or physical application of a protective coating upon the surface of otherwise flammable fibers usualy while in fabric form. It has been found however, that the protective coating may (a) impair the otherwise attractive properties of the fibers (e.g. render the same stiff and harsh), (b) pose a toxic hazard particularly to the skin, (c) lose its effectiveness upon laundering, or (d) be incompatible with other finishes such as durable press, water - and soil-repellent resins, and dyeing processes.

Additionally, various proposals have have been made for the preparation of fibers which chemically are different from those which have achieved widespread usage and which are formed from a polymeric material having non-burning characteristics. Such fibers (a) commonly are difficult to prepare, (b) are considerably more expensive than the fibers presently marketed on a large scale, and (c) often lack the aesthetic properties sought for widespread mareketability. For instance, modacrylics commonly exhibit poor thermal properties and are difficult to dye. Aromatic polyamides tend to be expensive, to exhibit poor uv stability, and when dyed to fade readily. Polybenzimidazoles tend to be expensive and to be available only in the natural gold or brown color.

When a flame inhibiting component has been incorporated within a common synthetic fiber (e.g. by copolymerization), usually there has been observed an undesirable change in the resulting polymer, such as a reduction of melting point, a reduction in crystallinity, or other changes which generally tend to diminish end use fiber properties. Also it has been proposed to physically blend a flame inhibiting component within a synthetic fiber such as by coextrusion from a melt blend or from a common solution. This requires careful choice of an effective inhibiting component if other desired properties of the resulting fiber, such as strength, hand, color, etc., are to be maintained at the desired levels. Particular difficulties have been encountered in the past when one has attempted to inhibit the flammability of common fiber blends which are formed from melting and non-melting components, e.g. polyester/cotton fiber blends.

It is an object of the present invention to provide an admixture of separate and distinct fibers which is non-burning when subjected to a standard flame.

It is an object of the present invention to provide an inproved process for imparting flame resistance characteristics to fibers which would normally be expected to burn when subjected to a standard flame.

It is an object of the present invention to provide a flame resistant fiber admixture having satisfactory textile properties.

It is an object of the present invention to provide a fiber blend having satisfactory textile properties and resistance to burning when subjected to flame in accordance with the ignition procedure of the Children's Sleepwear Test (i.e. DOC FF 3-71).

It is an object of the present invention to provide a flame resistant fiber admixture which includes a substantial quantity of fibers which normally would be expected to undergo burning when subjected to a standard flame.

It is an object of the present invention to provide an improved flame resistant fiber blend which includes a substantial proportion of ordinary polyester and cotton fibers.

It is an object of the present invention to provide an improved flame resistant fiber blend which resists melt dripping when subjected to a standard flame.

It is an object of the present invention to provide an improved process for imparting flame resistance to ordinary textile fibers without deterioration in the textile properties thereof, e.g. hand and aesthetic appeal.

It is an object of the present invention to provide an improved process for rendering a polyester/cotton fiber blend flame retardant.

It is an object of the present invention to provide an improved process for rendering wool fibers flame retardant.

These and other objects, as well as the scope, nature and utilization of the claimed process, will be apparent from the following description and appended claims.

SUMMARY OF THE INVENTION

It has been found that a flame-retardant admixture of fibers comprises:

a. discrete fibers which if present apart from the admixture undergo burning when subjected to a methane diffusion flame in an oxygen-containing atmosphere having a molecular oxygen content selected from within the range of about 20 to 40 percent by volume, and b. discrete fibers consisting primarily of a synthetic aromatic polymer containing chlorine, bromine, or mixtures thereof chemically bound to an aromatic ring having the inherent ability to render the admixture as a whole non-burning when subjected to the flame in the oxygen-containing gaseous atmosphere of the same oxygen content.

It has been found that a process for rendering discrete fibers flame retardant which have a propensity to undergo burning when subjected to a methane diffusion flame in an oxygen-containing gaseous atmosphere having an oxygen content selected from within the range of about 20 to 40 percent by volume comprises intimately blending in physical admixture therewith discrete fibers consisting primarily of a synthetic aromatic polymer containing chlorine, bromine, or mixtures thereof chemically bound to an aromatic ring having the inherent ability to render the admixture as a whole non-burning when subjected to said flame in the oxygen-containing atmosphere of the same oxygen content.

The fiber admixture of the present invention may be utilized in a wide variety of applications, e.g. thermal insulation, carpets, textiles, apparel, etc.

DESCRIPTION OF THE PREFERRED EMBODIMENTS

The present invention may be utilized to enhance the flame resistance of fibers without a modification in the othewise desirable properties thereof. More specifically, fibers which would normally burn or undergo combustion when exposed to a standard flame can be rendered non-burning when exposed to such conditions.

Both synthetic polymeric fibers and natural fibers can be rendered flame resistant in accordance with the present invention. Representative fibers which can be rendered flame resistant include polypropylene; polyamides, both aromatic (e.g. poly-m-phenylene isophthalamide and poly-m-phenylne terephthalamide) and aliphatic (e.g. nylon 66 and nylon 6); polybenzimidazoles (e.g. poly-2,2'-[m-phenylene]-5,5'-bibenzimidazole); polyesters (e.g, polyethylene terephthalate or polybutylene terephthalate); cellulose acetate; cellulose triacetate; cotton; wool; etc. and mixtures of the foregoing. The invention particularly is suited for use in conjunction with burnable polyester synthetic fibers such as polyethylene terephthalate, polypropylene, and natural fibers such as cotton and wool. Common polyester/cotton blends e.g. polyethylene terephthalate/cotton blends, containing about 35 to 90 percent by weight polyester and 10 to 65 percent by weight cotton can be effectively rendered flame resistant. Additionally polyamide/cotton or polyamide/cotton/polyester blends can be effectively rendered flame retardant.

The burnable fiber component may be provided in any one of a variety of physical configurations, e.g. fluff, sliver, yarns, tows, rovings, fibrids, filaments, etc., and may consist of staple or continuous fibers. Any discontinuous fibers selected commonly have an aspect ratio of at least 100.

In order to test whether a given fiber admixture burns at a given oxygen level a knitted or woven sample of the same having a longest dimension of 10 inches may be mounted and ignited in accordance with the ignition procedure of the Children's Sleepwear Test, i.e. DOC FF 3-71. The fibers undergoing testing conveniently may be knitted to form a specimen having a fabric weight of about 8 ounces per square yard. More specifically, a methane diffusion flame having a length of 1½ inches is caused to impinge upon the bottom edge of the specimen for 3 seconds and is then removed while the specimen is mounted in a cabinet containing a 20 to 40 percent by volume oxygen content. The specimen includes a 3/16 inch seam and is provided in a fixed vertical position in a holder as a flat double layer. The methane is supplied to the burner at 2½ psig. For the purpose of the present invention if the specimenis consumed by combustion within the flame or continues to burn in excess of 30 seconds after the flame is removed, then the fibers undergoing testing are considered to burn (i.e. to undergo burning) and to have failed the test. In a preferred embodiment of the invention the specimen is not consumed by combustion within the flame and does not burn in excess of 10 seconds after the flame is removed. The relative size of the resulting char length observable on the specimen also may be utilized as a measure of the flame resistance of the sample. The shorter the char length the greater the flame resistance. The utilization of a gaseos atmosphere having an oxygen level in excess of that of air (e.g. in excess of 20.9 percent by volume) makes possible the demonstration of the usefulness of the present invention with fibers which would normally be non-burning in air, e.g. poly-m-phenylene isophthalamide and poly-2,2'-[m-phenylene]-5,5'-bibenzimidazole, but which may burn in a specialized environment of higher oxygen level, e.g. in an aerospace or medical application.

Alternatively, the burning characteristics of more common fibers satisfactorily may be more simply tested when employing an ordinary match flame test at ambient conditions. The match flame may be caused to impinge upon a fiber sample for three seconds. If the specimen is consumed by combustion within the flame or continues to burn in excess of 30 seconds after the flame is removed, then the fibers undergoing testing are considered to burn (i.e. to undergo burning) and to have failed the test. In a preferred embodiment of the invention the specimen is not consumed by combustion within the flame and does not burn in excess of 10 seconds after the flame is removed. If desired, a woven or knitted sample of the fibers conveniently may be mounted in a frame prior to impingement with a match flame at the lower edge thereof in accordance with the mounting procedure of DOC FF 3-71.

In the present invention a blend of fibers is formed wherein the burnable fibers are admixed with additive fibers consisting primarily of a synthetic aromatic polymer containing chlorine, bromine, or mixtures thereof chemically bound to an aromatic ring having the inherent ability to render the admixture as a whole non-burning when subjected to a standard flame. Each fiber component of the resulting admixture is discrete in the sense that the components thereof remain separate and distinct and are solely in physical admixture.

In a preferred embodiment the additive fibers consist primarily of a fiber-forming synthetic chlorinated or brominated aromatic polymer having a chlorine and/or bromine content of about 15 or 60 percent by weight based upon the weight of the aromatic polymer, e.g. a chlorine and/or bromine content of about 25 to 50 percent by weight. Such aromatic polymer is chlorinated and/or brominated in the sense that these substituent groups are directly attached to an aromatic ring. Particularly satisfactory results are achievable when the halogen substituents upon the aromatic ring are bromine.

Representative additive fibers for use in the present invention consist primarily of a chlorinated and/or brominated aromatic polyester of the recurring structural formula:

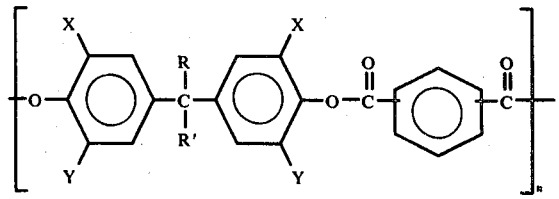

where X is chlorine or bromine, Y is hydrogen, chlorine or bromine, R and R′ may be the same or different and represent lower alkyl groups (e.g. 1 to 5 carbon atoms) or hydrogen or together constitute a cyclic hydrocarbon group, and $n$ = at least 25, e.g. about 40 to 400. The end group of the polymer illustrated in the formula commonly are —OH, or $$-\overset{\overset{\displaystyle O}{\|}}{C}-OH$$

depending upon the synthesis route selected as will be apparent to those skilled in the art. Suitable methods for the manufacture of such aromatic polyesters are disclosed in U.S. Pat. Nos. 2,035,578 and 3,234,167, Australian Pat. No. 242,803, British Pat. No. 924,607, commonly assigned U.S. Ser. Nos. 351,206, filed Apr. 16, 1973 (now U.S. Pat. No. 3,824,213) and 401,081 filed Sept. 26, 1973 (now abandoned), which are herein incorporated by reference. The chlorinated or brominated aromatic polyester may be formed by the condensation of tetrachlorobisphenol A (i.e. 4,4′-isopropylidene-2,2′,6,6′-tetrachlorodiphenol) or tetrabromobisphenol A (i.e. 4,4′-isopropylidene-2,2′,6,6′-tetrabromodiphenol) with isophthalic acid and/or terephthalic acid or the ester-forming derivatives thereof.

A preferred chlorinated aromatic polyester is formed by the condensation of tetrachlorobisphenol A (i.e. 4,4′-isopropylidene-2,2′,6,6′tetrachlorodiphenol) with an aromatic acid mixture of about 90 to 40 percent isophthalic acid (e.g. 80 to 60 percent by weight) and correspondingly about 10 to 60 percent by weight terephthalic acid (e.g. 20 to 40 percent by weight) or the ester-forming derivatives thereof. For instance, a lower carboxylic acid diester of a monocarboxlic acid possessing 2 to 5 carbon atoms and tetrachlorobisphenol A may be reacted with a mixture of terephthalic acid and isophthalic acid in the presence of an appropriate solvent and catalyst. A preferred brominated aromatic polyester is formed by the condensation of tetrabromobisphenol A (i.e. 4,4′-isopropylidene-2,2′,6,6′-tetrabromodiphenol) with a aromatic acid mixture of about 45 to 75 percent by weight isophthalic acid and correspondingly about 55 to 25 percent by weight terephthalic acid or the ester-forming derivatives thereof. For instance, tetrabromobisphenol A may be reacted with a mixture of isophthaloyl chloride and terephthaloyl chloride in the presence of an appropriate solvent and catalyst to produce a polymer having -OH and $$-\overset{\overset{\displaystyle O}{\|}}{C}-OH$$

end groups. Such polymers may be spun into the required additive fibers via dry spinning or wet spinning techniques and offer the additional advantage of exhibiting highly satisfactory physical properties following hot drawing which render the same amenable to textile applications, e.g. they possess a good hand and aesthetic appeal.

Additional representative additive fibers for use in the present invention are other polyesters, polycarbonates, polyamides and polyurethanes which contain chlorine, bromine, or mixtures thereof chemically bound to an aromatic ring. For instance, monomers such as tetrachlorobisphenol A, tetrabromobisphenol A, 2,5-dichloroterephthalic acid, 2,5-dibromoterephthalic acid, 2,3,5,7-tetrachloroterephthalic acid, and 2,3,5,7-tetrabromoterephthalic acid, di(hydroxy ethoxy ether) of tetrachlorobisphenol A, di(hydroxy ethoxy ether) of tetrabromobisphenol A, diethoxylated 2,5-dichlorohydroquinones, and diethoxylated 2,5-dibromohydroquinones, etc., may supply the chlorine and/or bromine when incorporated in the polymer chain. Preferably those additive fibers are selected which do not substantially visually detract from the otherwise desirable properties of the burnable fibers of the blend when aesthetic considerations are of importance, and which have a melting point of at least 180° C. (e.g. a melting point of at least 200° C.).

In a preferred embodiment of the invention additive fibers consisting primarily of synthetic chlorinated and/or brominated aromatic polymer additionally include a minor proportion of an oxide of antimony, e.g. antimony trioxide ($Sb_2O_3$) or antimony pentoxide ($Sb_2O_5$) intimately dispersed therein. The oxide of antimony component may be simply dispersed in the spinning solution from which the additive fiber is formed and when present within the resulting fiber makes possible the utilization of a lesser quantity of the additive fiber in order to impart the requisite flame-retardant characteristics to the fiber admixture. The antimony trioxide which may be incorporated in the additive fiber is sometimes identified as antimony white, or antimony oxide. The antimony pentoxide component is sometimes identified as antimonic anhydride, antimonic acid or stibic anhydride. Commonly the oxide of antimony is provided in the additive fiber in a concentration of 0.1 to 20 percent by weight (e.g. 0.4 to 8 percent by weight) based upon the weight of said chlorinated and/or brominated aromatic polymer. The particle size of the oxide of antimony is sufficiently small that it does not obstruct or otherwise interfere with the extrusion of the spinning solution during fiber formation.

It has been found that as the resulting blend is subjected to flame the additive fibers undergo a partial decomposition to form a reaction product which is capable of rendering the adjoining burnable fibers nonburning. For instance, the chlorinated and/or brominated aromatic polymer of the additive fibers inherently may yield volatile chlorinated or brominated molecules capable of retarding combustion. The additional presence of the oxide of antimony within the additive fibers may serve to facilitate the formation of an antimony halide, e.g. antimony chloride, or antimony bromide, which helps to impart the desired flame-retardant characteristics to the entire blend. If desired, other compounds capable of enhancing the formation of a beneficial reaction product optionally may be incorporated in the additive fibers. For instance, a portion of the oxide of antimony may be replaced by a transition metal oxide, such as titanium dioxide.

The additive fiber component of the fiber admixture may be provided in any one of a variety of physical configurations, e.g. fluff, silver, yarns, tows, rovings, fibrids, filaments, etc., and may consist of staple or continuous fibers. Any discontinuous fibers selected commonly have an aspect ratio of at least 100.

The fiber blend or admixture of the present invention may be formed by physically dispersing the separate and distinct additive fibers throughout the burnable fibers. The resulting blend or admixture may take the form of a random array of staple fibers suitable for further processing or a highly ordered fiber assemblage, such as a woven or knitted fabric. Within an ordered fabric the discrete fibers of each component of the blend may be intimately admixed within each of the yarns forming the same, or the blend may take the form of substantially homogeneous yarns of each component which are provided in close proximity (e.g. preferably adjoining contact). Alternatively, the blend or admixture may take the form of a non-woven sheet. Suitable apparatus for forming blends of staple fibers include cards, drawframes, twisters, webbing machines, flockers, random pneumatic webbers, or other devices for plying filaments or blending staple.

The relative amount of each component provided in the blend is adjusted until at least a sufficient quantity of the additive fibers are present within the admixture to render the admixture as a whole non-burning when subjected to a standard flame. The quantity of additive fibers required will be influenced at least in part by the propensity for burning exhibited by the burnable fibers, the degree of intimate association between the discrete burnable fibers and the discrete additive fibers within the blend, the relative ability of the additive fiber selected to impart non-burning characteristics to the entire blend, and the presence or absence of an oxide of antimony or other beneficial compound within the additive fiber. The determination of the minimum quantity of additive fiber required in a given instance may be carried out by routine experimentation. Commonly the burnable fibers of the blend are provided in a concentration of about 20 to 90 percent by weight (e.g. 35 to 85 percent by weight), and the additive fibers in a concentration of about 10 to 80 percent by weight (e.g. 15 to 65 percent by weight).

The present invention offers a highly useful technique for rendering burnable fibers flame-retardant. Those difficulties commonly associated with the production of flame-retardant fibers via techniques of the prior art are largely eliminated. A fiber blend readily may be formed which incorporates a substantial proportion of conventional fibers and which exhibits the desired flame-retardant properties without any substantial diminution in the physical properties thereof. The fiber admixture may be processed using standard commercially available textile machinery. No wet fiber treatment operations are required which might otherwise be foreign to a textile factory. The melt dripping of flaming particles is substantially eliminated. An added measure of fire safety is beneficially provided to the users of the resulting fiber blend. The burnable fibers are not changed with respect to hand or other aesthetics.

The resulting blend may be utilized in both textile and non-textile applications. For instance, thermal insulation, acoustical insulation, carpets, textiles, wall coverings, hospital cubicle draperies, slippers, upholstery, thread, apparel, etc. may be formed from the same.

It further has been demonstrated that a durable press resin may be applied to fabrics formed of the flame-retardant admixture of the present invention with no substantial modification of the flame retardance thereof.

The following examples are given as specific illustrations of the claimed invention. It should be understood, however, that the invention is not limited to the specific details set forth in the examples.

EXAMPLE 1

A synthetic polymer containing chlorine chemically bound to an aromatic ring is formed by reacting with stirring 190.9 parts by weight of tetrachlorobisphenol A in about 2800 parts by weight methylene chloride solvent with 75.6 parts by weight isophthaloyl chloride and 32.4 parts by weight terephthaloyl chloride in the presence of 116 parts by weight of triethylamine acid acceptor at 40° C. The reaction is carried out with agitation for 3 hours. When the reaction is complete triethylamine is extracted with a 3 percent hydrochloric acid solution and the reaction mixture is washed with water until a pH of 6 is achieved. The resulting chlorinated polyester is recovered by precipitation with methanol and possesses the appearance of a white fibrous flake and the structural formula heretofore illustrated where X and Y are chlorine groups, R and R′ are methyl groups, and $n$=about 80. The chlorinated aromatic polyester has a chlorine content of about 27 percent by weight, a melting point above about 338° C., and exhibits an inherent viscosity of about 0.8 deciliters per gram determined at a concentration of 0.1 percent by weight in a solvent which is a mixture of 10 parts by weight phenol and 7 parts by weight trichlorophenol.

100 parts by weight of the chlorinated aromatic polyester are dissolved in 300 parts by weight of methylene chloride spinning solvent. The solution is filtered and 2 parts by weight of antimony trioxide are introduced. The resulting solution containing dispersed antimony trioxide is deaerated, and which at a solution temperature of about 70° C. is extruded through a chrome plated stainless steel spinneret having 20 circular holes of 42 microns diameter each. The as-spun filamentary material is passed into an air chamber provided at 70° C. which flows concurrently and wherein the filamentary material is completely solidified and subsequently is wound up at a rate of 200 meters per minute.

The filamentary material next is hot drawn at a draw ratio of about 4:1 by contact with a 12 inch hot shoe provided at about 315° C.

The drawn filamentary material is crimped by passage through a steam stuffer box and is cut into 1½ inch lengths having an antimony trioxide content of about 2 percent by weight based upon the weight of the chlorinated aromatic polyester.

56 parts by weight of the chlorinated aromatic polyester fibers are carded with 44 parts by weight of drawn and crimped polyethylene terephthalate fibers having a length of about 1½ inches to form a uniform physical admixture of the fibers.

When a portion of the blend is knitted into a circular hoseleg and subjected to a methane diffusion flame for three seconds as described in the mounting and ignition description of the standard Children's Sleepwear Test, i.e. DOC FF 3-71, it is found that the specimen does not undergo burning. More specifically, it is found that no burning occurs after removal of the methane diffusion flame and there is no melt drip. The char length averages 1 inch. Also, when the blend is subjected to an ordinary match flame for three seconds at ambient conditions as heretofore described it is nonburning. The presence of the chlorinated aromatic polyester renders the entire blend non-burning.

In control tests wherein solely the polyethylene terephthalate fibers apart form the blend are subjected to the same methane diffusion and match flames in air, they frequently burn vigorously in each instance until totally consumed and drip molten droplets which sometimes continue to burn afte falling to the floor of the test chamber.

EXAMPLE 2

Example 1 is repeated with the exception that 50 parts by weight of the chlorinated aromatic polyester fibers containing 4 percent by weight antimony trioxide based upon the weight of the chlorinated aromatic polyester are carded with 15 parts by weight of cotton staple having a fiber length of about 1.5 inch, and 35 parts by weight of drawn and crimped polyethylene terephthalate fibers having a length of about 1.5 inch.

The resulting blend passes the standard methane diffusion and match flame tests when present in an air atmosphere. No burning occurs after removal of the methane diffusion flame and there is no melt drip. The char length averages 1 inch. Controls containing about 30 parts by weight cotton staple and about 70 parts by weight polyethylene terephthalate fail both tests.

EXAMPLE 3

Example 1 is repeated with the exception that 76 parts by weight of chlorinated aromatic polyester fibers which contain 2 percent by weight of antimony trioxide based upon the weight of the chlorinated aromatic polyester are carded with 20 parts by weight of cotton staple having a fiber length of about 1.5 inch, and 4 parts by weight of drawn and crimped polyethylene terephthalate fibers having a length of about 1.5 inch.

The resulting blend is non-burning when subjected to the standard methane diffusion and match flame tests when present in an air atmosphere. No burning occurs after removal of the methane diffusion flame and there is no melt drip. The char length average 0.5 inch. Controls containing about 83 parts by weight cotton staple and 17 parts by weight polyethylene terephthalate burn completely when subjected to both tests.

EXAMPLE 4

201.7 parts by weight tetrabromobisphenol A, 46.0 parts by weight isophthaloyl chloride and 30.8 parts by weight of terephthaloyl chloride are reacted to form a brominated aromatic polyester in the presence of about 2600 parts by weight methylene chloride solvent and 82 parts by weight of triethylamine acid acceptor.

The contents of the reaction zone are heated at about 40° C. with agitation for 3 hours. When the reaction is complete triethylamine is extracted with a 3 percent hydrochloric acid solution and the reaction mixture is washed with water until a pH of 6 is achieved. The resulting brominated polyester is recovered by precipitation with methanol. The brominated aromatic polyester has the appearance of a white, fibrous flake and possesses the structural formula heretofore illustrated where X and Y are bromine groups, R and R′ methyl groups, and $n$ = about 50. The brominated aromatic polyester has a bromine content of about 48 percent by weight, a melting point of about 265° C., and exhibits an inherent viscosity of about 0.75 deciliters per gram determined at a concentration of 0.1 percent by weight in a solvent which is a mixture of 10 parts by weight of phenol and 7 parts by weight trichlorophenol.

100 parts by weight of the brominated aromatic polyester are dissolved in 300 parts by weight of a methylene chloride spinning solvent. The solution is filtered and deaerated and extruded through a chrome plated stainless steel spinneret having 20 circular holes of 44 microns diameter each. The as-spun filamentary material is passed into an air chamber provided at 70° C. which flows concurrently and wherein the filamentary material is completely solidified and subsequently is taken up at a rate of 200 meters per minute.

The filamentary material next is hot drawn at a draw ratio of about 4:1 by contact with a 12 inch hot shoe provided at about 325° C.

The drawn filamentary material is crimped by passage through a steam stuffer box and cut into 1½ inch lengths which are free of an oxide of antimony.

45 parts by weight of the brominated aromatic polyester are carded with 35 parts by weight of drawn and crimped polyethylene terephthalate fibers hving a length of about 1.5 inch and 20 parts by weight of cotton staple having a fiber length of about 1.5 inch to form a uniform physical admixture of the fibers.

When a portion of the blend is knitted into a circular hoseleg and subjected to a methane diffusion flame in air for three seconds as described in the mounting and ignition description of the standard Children's Sleepwear Test, i.e. DOC FF 3-71, it is found that the blend is non-burning. More specifically, it is found that the fabric extinguishes in an average time of one second after the flame is removed and there are no burning drops. The average char length is 0.5 inch. Also, when the blend is subjected to an ordinary match flame for 3 seconds at ambient conditions as heretofore described it is non-burning. The presence of the brominated aromatic polyester renders the entire blend non-burning.

In control tests wherein a blend of 65 parts by weight of terephthalate fibers and 35 parts by weight of the cotton fibers are subjected to the same tests they burn vigorously in both instances until totally consumed and drip burning droplets.

EXAMPLES 5–18

Example 4 is repeated with the exception that a minor quantity of antimony trioxide is dispersed in the methylene chloride spinning solvent and is dispersed in the resulting brominated aromatic polyester fibers in the quantities indicated. Also the relative proportions of cotton and polyethylene terephthalate fibers in the blend are varied as indicated.

When a portion of each blend is knitted into a circular hoseleg and subjected to a methane diffusion flame in air for 3 seconds as described in the mounting and ignition procedure of the standard Children's Sleepwear Test, i.e. DOC FF 3-71 it is found that the blend is non-burning in each instance. The details are set forth below.

| Example No. | Parts by Weight Brominated Aromatic Polyester Fibers | Percent Antimony Trioxide Based Upon Weight of Brominated Aromatic Polyester | Parts by Weight Cotton FIbers | Parts by Weight Polyethylene Terephthalate Fibers | Average Burn Time Following Removal of Methane Diffusion Flame in Seconds | Average Char Length in Inches |
|---|---|---|---|---|---|---|
| 5 | 36.1 | 1.9 | 20 | 43.9 | 5 | 1.7 |
| 6 | 40 | 1.9 | 20 | 40 | 1 | 1.0 |
| 7 | 15 | 2.6 | 0 | 85 | 2.8 | 0.9 |

-continued

| Example No. | Parts by Weight Brominated Aromatic Polyester Fibers | Percent Antimony Trioxide Based Upon Weight of Brominated Aromatic Polyester | Parts by Weight Cotton Fibers | Parts by Weight Polyethylene Terephthalate Fibers | Average Burn Time Following Removal of Methane Diffusion Flame in Seconds | Average Char Length in Inches |
|---|---|---|---|---|---|---|
| 8 | 25 | 2.6 | 0 | 75 | 0 | 1.0 |
| 9 | 25 | 2.6 | 15 | 60 | 2.4 | 0.8 |
| 10 | 30 | 2.6 | 15 | 55 | 1 | 0.6 |
| 11 | 30 | 3.6 | 25 | 45 | 0.6 | 0.5 |
| 12 | 32.5 | 2.6 | 25 | 42.5 | 1.2 | 0.8 |
| 13 | 35 | 2.6 | 20 | 45 | 1.9 | 0.8 |
| 14 | 40 | 2.6 | 25 | 35 | 4.8 | 1.1 |
| 15 | 75 | 3.0 | 25 | 0 | 0 | 0.8 |
| 16 | 65 | 5.5 | 35 | 0 | 1 | 1.0 |
| 17 | 25 | 8.0 | 26 | 49 | 2 | 0.9 |
| 18 | 30 | 8.0 | 24.5 | 45.5 | 0 | 0.5 |

Also, when the blends of the above Examples 5–18 are subjected to an ordinary match flame for 3 seconds at ambient conditions as heretofore described they are non-burning. In control tests when the brominated aromatic polyester fibers are omitted specimens of the other blend components burn vigorously in both instances.

EXAMPLES 19–21

Example 4 is repeated with the exception that a minor quantity of antimony trioxide is dispersed in the methylene chloride spinning solvent and is dispersed in the resulting brominated aromatic polyester fibers in the quantity indicated. The brominated aromatic polyester fibers are blended with wool fibers in the relative proportions indicated.

When a portion of each blend is knitted into a circular hoseleg and subjected to a methane diffusion flame in air for 3 seconds as described in the ignition procedure of the standard Children's Sleepwear Test, i.e. DOC FF 3-71, it is found that the blend is non-burning in each instance. The details are set forth below.

| Example No. | Parts By Weight Brominated Aromatic Polyester Fibers | Percent Antimony Trioxide Based Upon Weight of Brominated Aromatic Polyester | Parts by Weight Wool Fibers | Average Burn Time Following Removal of Methane Diffusion Flame in Seconds | Average Char Length in Inches |
|---|---|---|---|---|---|
| 19 | 10 | 2.6 | 90 | 2.6 | 1.7 |
| 20 | 15 | 2.6 | 85 | 0 | 1 |
| 21 | 20 | 2.6 | 80 | 0 | 0.5 |

the brominated aromatic polyester fibers are omitted the wool specimens burn vigorously in both instances.

EXAMPLES 22–24 Also, when the blends of the above Examples 19–21 are subjected to an ordinary match flame for 3 seconds at ambient conditions as heretofore described they are non-burning. In control tests when Example 4 is repeated with the exception that a minor quantity of antimony trioxide is dispersed in the methylene chloride spinning solvent and dispersed in the resulting brominated aromatic polyester fibers in the quantity indicated. Also, the blends included nylon 66 and cotton fibers and in one example polyethylene terephthalate fibers as indicated.

When a portion of each blend is knitted into a circular hoseleg and subjected to a methane diffusion flame in air for three seconds as described in the mounting and ignition procedure of the standard Children's Sleepwear Test, i.e. DOC FF 3-71, it is found that the blend is non-burning in each instance. The details are set forth below.

| Example No. | Part by Weight Brominated Aromatic Polyester Fibers | Percent Antimony Trioxide Based Upon Weight of Brominated Aromatic Polyester | Parts By Weight Nylon 66 Fibers | Parts by Weight Cotton Fibers | Parts by Weight Polyethylene Terephthalate Fibers | Average Burn Time Following Removal of Methane Diffusion Flame in Seconds | Average Char Length in Inches |
|---|---|---|---|---|---|---|---|
| 22 | 31.7 | 2.6 | 38.3 | 30 | 0 | 3.6 | 0.8 |
| 23 | 40 | 2.6 | 30 | 30 | 0 | 1.1 | 0.8 |
| 24 | 35 | 2.6 | 5 | 25 | 35 | 3 | 1 |

Also, when the blends of the above Examples 22–24 are subjected to an ordinary match flame for 3 seconds at ambient conditions as heretofore described they are non-burning. In control tests when the brominated aromatic polyester fibers are omitted the specimens of the other blend components burn vigorously.

EXAMPLES 25–26

Example 4 is repeated with the exception that a minor quantity of antimony trioxide is dispersed in the methylene chloride spinning solvent and dispersed in the resulting brominated aromatic polyester fibers in the quantity indicated. Polypropylene fibers are blended with the brominated aromatic polyester fibers in the quantities indicated.

When a portion of each blend is knitted into a circular hoseleg and subjected to a methane diffusion flame in air for three seconds as described in the mounting and ignition procedure of the standard Children's Sleepwear Test, i.e. DOC FF 3-71, it is found that the blend is non-burning in each instance. The details are set forth below.

| Example No. | Parts by Weight Brominated Aromatic Polyester Fibers | Percent Antimony Trioxide Based Upon Weight of Brominated Aromatic Polyester | Parts by Weight Polypropylene Fibers | Average Burn Time Following Removal of Methane Diffusion Flame in Seconds | Average Char Length In Inches |
|---|---|---|---|---|---|
| 25 | 30 | 2.6 | 70 | 8.5 | 1.5 |
| 26 | 50 | 2.6 | 50 | 0 | 1 |

Also, when the blends of the above Examples 25–26 are subjected to an ordinary match flame for 3 seconds at ambient conditions as heretofore described they are non-burning. In control tests when the brominated aromatic polyester fibers are omitted, the polypropylene fibers burn vigorously.

EXAMPLE 27

Example 4 is repeated with the exception that a minor quantity of antimony trioxide is dispersed in the methylene chloride spinning solvent and dispersed in the resulting brominated aromatic polyester fibers in a concentration of 2.6 percent by weight based upon the weight of the brominated aromatic polyester. 20 parts by weight of the brominated aromatic polyester fibers are blended with 80 parts by weight poly-m-phenylene isophthalamide fibers.

When a portion of the blend is knitted into a circular hoseleg and subjected to a methane diffusion flame of 1½ inches in oxygen enriched air atmosphere having an oxygen concentration of 34.5 percent by volume in accordance with the mounting and ignition procedure of the standard Children's Sleepwear Test, i.e. DOC FF 3-71, the blend is non-burning. However, when the brominated aromatic polyester fibers are omitted in a control test, and tested in the same atmosphere, the poly-m-phenylene isophthalamide fibers burn.

This Example demonstrates the usefulness of the present invention with fibers which would normally be non-burning at ambient conditions, but which burn in a specialized environment of higher oxygen level.

EXAMPLE 28

Example 4 is repeated with the exception that a minor quantity of antimony trioxide is dispersed in the methylene chloride spinning solvent and dispersed in the resulting brominated aromatic polyester fibers in a concentration of 5.5 percent by weight based upon the weight of the brominated aromatic polyester. 50 parts by weight of the brominated aromatic polyester fibers are blended with 50 parts by weight of cellulose triacetate fibers.

When a portion of the blend is knitted into a circular hoseleg and subjected to a methane diffusion flame in air for three seconds as described in the mounting and ignition procedure of the standard Children's Sleepwear Test, i.e. DOC FF 3-71, it is found that the blend is non-burning. More specifically, no flame is present on the hoseleg following removal of the methane diffusion flame, no drops form, and the average char length is 1 inch. However, when the brominated aromatic polyester fibers are omitted in a control test, and tested under the same conditions, burning continued for an average of 47 seconds following the removal of the methane diffusion flame, the presence of flaming drops was observed, and the average char length measured 10 inches (i.e. the entire length of the sample).

Although the invention has been described with preferred embodiments it is to be understood that variations and modifications may be employed without departing from the concept of the invention as defined in the following claims.

We claim:

1. A flame retardant admixture of fibers comprising:

a. discrete fibers which if present apart from said admixture undergo burning when subjected to a methane diffusion flame in an oxygen-containing gaseous atmosphere having an oxygen content selected from within the range of about 20 to 40 percent by volume, and b. discrete fibers of a synthetic aromatic polymer containing chlorine, bromine, or mixtures thereof chemically bound to an aromatic ring having a chlorine and/or bromine content of about 25 to 50 percent by weight based upon the weight of said aromatic polymer and the inherent ability to render said admixture as a whole non-burning when subjected to said flame in said oxygen-containing gaseous atmosphere of the same oxygen content.

2. An admixture of fibers in accordance with claim 1 wherein said discrete fibers of component (a) are selected from the group consisting essentially of polypropylene, polyamides, polybenzimidazoles, polyesters, cellulose acetate, cellulose triacetate, cotton, wool, and mixtures of the foregoing.

3. An admixture of fibers in accordance with claim 1 wherein said discrete fibers of component (a) are cotton.

4. An admixture of fibers in accordance with claim 1 wherein said discrete fibers of component (a) are a mixture of cotton and polyester fibers.

5. An admixture of fibers in accordance with claim 1 wherein said discrete fibers of component (a) are polyamide fibers.

6. An admixture of fibers in accordance with claim 1 wherein said discrete fibers of component (a) are wool.

7. An admixture of fibers in accordance with claim 1 wherein said discrete fibers of component (b) additionally include a minor proportion of an oxide of antimony.

8. An admixture of fibers in accordance with claim 1 having the physical configuration of a woven fabric, a knitted fabric, or a non-woven sheet.

9. A flame retardant admixture of fibers comprising:

a. discrete fibers which if present apart from said admixture undergo burning when subjected to a methane diffusion flame in an oxygen-containing gaseous atmosphere having an oxygen content selected from within the range of about 20 to 40 percent by volume, and b. discrete polyester fibers of a synthetic chlorinated or brominated aromatic polymer having the recurring structural formula:

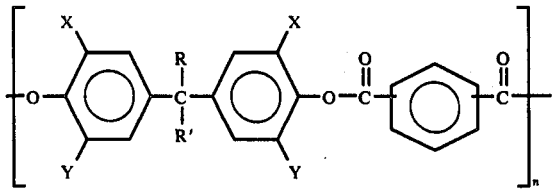

where X is chlorine or bromine, Y is hydrogen, chlorine or bromine, R and R′ may be the same or different and represent lower alkyl groups, hydrogen, or together constitute a cyclic hydrocarbon group, and $n$= at least 25, and a chlorine and or bromine content of about 25 to 50 percent by weight based upon the weight of said aromatic polyester capable of rendering said admixture as a whole non-burning when subjected to said flame in said oxygen-containing gaseous atmosphere of the same oxygen content.

10. An admixture of fibers in accordance with claim 9 wherein said discrete fibers of component (a) are selected from the group consisting essentially of polypropylene, polyamides, polybenzimidazoles, polyesters, cellulose acetate, cellulose triacetate, cotton, wool, and mixtures of the foregoing.

11. An admixture of fibers in accordance with claim 9 wherein said discrete fibers of component (a) are cotton.

12. An admixture of fibers in accordance with claim 9 wherein said discrete fibers of component (a) are a mixture of cotton and polyester fibers.

13. An admixture of fibers in accordance with claim 9 wherein said discrete fibers of component (a) are polyamide fibers.

14. An admixture of fibers in accordance with claim 9 wherein said discrete fibers of component (a) are wool.

15. An admixture of fibers in accordance with claim 9 wherein said aromatic polymer of component (b) is a polyester product of tetrachlorobisphenol A, isophthalic acid, and terephthalic acid or the ester-forming derivatives thereof.

16. An admixture of fibers in accordance with claim 9 wherein said aromatic polymer of component (b) is a polyester product of tetrabromobisphenol A, isophthalic acid, and terephthalic acid or the ester-forming derivatives thereof.

17. An admixture of fibers in accordance with claim 9 wherein said discrete fibers of component (b) additionally include a minor proportion of an oxide of antimony intimately dispersed therein.

18. An admixture of fibers according to claim 9 comprising about 20 to 90 percent by weight of component (a), and about 10 to 80 percent by weight of component (b).

19. An admixture of fibers in accordance with claim 9 having the physical configuration of a woven fabric, a knitted fabric, or a non-woven sheet.

20. A flame retardant admixture of fibers exhibiting satisfactory textile properties which is non-burning when subjected to an ordinary match flame at ambient conditions comprising:

a. about 20 to 90 percent by weight of discrete fibers which if present apart from said admixture undergo burning when subjected to an ordinary match flame at ambient conditions, and b. about 10 to 80 percent by weight of discrete aromatic polyester fibers formed from the reaction of tetrabromobisphenol A, and a mixture of about 45 to 75 percent by weight isophthalic acid and correspondingly about 55 to 25 percent by weight terephthalic acid or the ester-forming derivatives thereof having a bromine content of about 48 percent by weight and having intimately dispersed therein about 0.1 to 10 percent by weight based upon the weight of said aromatic polyester of an oxide of antimony, with said discrete fibers of component (b) being capable of rendering said admixture as a whole non-burning when subjected to an ordinary match flame at ambient conditions.

21. An admixture of fibers according to claim 20 wherein said discrete fibers of component (a) are cotton.

22. An admixture of fibers according to claim 20 wherein said discrete fibers of component (a) are a mixture of cotton and polyester fibers.

23. An admixture of fibers according to claim 22 wherein said discrete fibers of component (a) are a mixture of cotton and polyethylene terephthalate fibers.

24. An admixture of fibers in accordance with claim 20 wherein said discrete fibers of component (a) are polyamide fibers.

25. An admixture of fibers according to claim 22 wherein said aromatic polyester of component (b) is formed by the reaction of tetrabromobisphenol A and a mixture of 45 to 75 percent by weight isophthaloyl chloride and correspondingly 55 to 25 percent by weight terephthaloyl chloride.

26. An admixture of fibers according to claim 22 wherein said oxide of antimony of component (b) is present in a concentration of about 0.4 to 8 percent by weight based upon the weight of said aromatic polyester.

27. A process for rendering discrete fibers flame retardant which have a propensity to undergo burning when subjected to a methane diffusion flame in an oxygen-containing gaseous atmosphere having an oxygen content selected from within the range of about 20 to 40 percent by volume comprising intimately blending in physical admixture therewith discrete fibers of a synthetic aromatic polymer containing chlorine, bromine, or mixtures thereof chemically bound to an aromatic ring having a chlorine and/or bromine content of about 25 to 50 percent by weight based upon the weight of said aromatic polymer and the inherent ability to render said admixture as a whole non-burning when subjected to said flame in said oxygen-containing atmosphere of the same oxygen content.

28. A process according to claim 27 wherein said discrete fibers having a propensity to undergo burning when exposed to said flame are selected from the group consisting essentially of polypropylene, polyamides, polybenzimidazoles, polyesters, cellulose acetate, cellulose triacetate, cotton, wool, and mixtures of the foregoing.

29. A process according to claim 27 wherein said discrete fibers having a propensity to undergo burning when exposed to said flame are cotton.

30. A proess according to claim 27 wherein said discrete fibers having a propensity to undergo burning when exposed to said flame are a mixture of cotton and polyester fibers.

31. A process according to claim 27 wherein said discrete fibers having a propensity to undergo burning when exposed to said flame are wool.

32. A process according to claim 27 wherein said discrete fibers having a propensity to undergo burning when exposed to said flame are polyamide fibers.

33. A process according to claim 27 wherein said discrete fibers consisting primarily of said synthetic aromatic polymer additionally include a minor proportion of an oxide of antimony intimately dispersed therein.

34. A process for enhancing the flame resistance of discrete fibers comprising intimately blending in physical admixture therewith discrete fibers of a synthetic chlorinated or brominated aromatic polymer having a chloride and/or bromine content of about 25 to 50 percent by weight chemically bound to an aromatic ring.

35. A process for rendering discrete fibers flame retardant which undergo burning when exposed to a methane diffusion flame in an oxygen-containing gaseous atmosphere having an oxygen content selected from within the range of about 20 to 40 percent by volume comprising intimately blending in physical admixture therewith discrete fibers of a chlorinated or brominated aromatic polymer having the recurring structural formula:

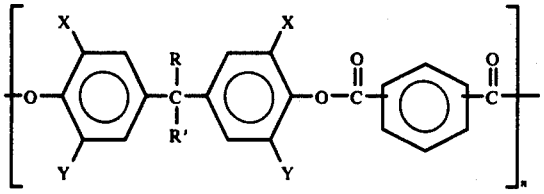

where X is chlorine or bromine, Y is hydrogen, chlorine or bromine, R and R' may be the same or different and represent lower alkyl groups, hydrogen, or together constitute a cyclic hydrocarbon group, and $n$= at least 25 and a bromine and/or chlorine content of about 25 to 50 percent by weight based upon the weight of said aromatic polymer capable of rendering said admixture as a whole non-burning when subjected to said flame in said oxygen-containing atmosphere of the same oxygen content.

36. A process according to claim 35 wherein said discrete fibers which undergo burning when exposed to said flame are selected from the group consisting essentially of polypropylene, polyamides, polybenzimidazoles, polyesters, cellulose acetate, cellulose triacetate, cotton, wool, and mixtures of the foregoing.

37. A process according to claim 35 wherein said discrete fibers which undergo burning when exposed to said flame are cotton.

38. A proccess according to claim 35 wherein said discrete fibers which undergo burning when exposed to said frame are a mixture of cotton and polyethylene terephthalate fibers.

39. A process according to claim 35 wherein said discrete fibers which undergo burning when exposed to said flame are wool.

40. A process according to claim 35 wherein said discrete fibers which undergo burning when exposed to said flame are polyamide fibers.

41. A process according to claim 35 wherein said chlorinated or brominated aromatic polymer is a condensation product of tetrabromobisphenol A, isophthalic acid, and terephthalic acid or the ester-forming derivatives thereof.

42. A process according to claim 35 wherein said discrete fibers consisting primarily of said chlorinated and/or brominated aromatic polymer additionally include a minor proportion of an oxide of antimony intimately dispersed therein.

43. A process according to claim 35 wherein the relative proportions of the discrete fibers which are blended are such that the resulting physical admixture comprises about 20 to 90 percent by weight of said fibers which undergo burning when exposed to said flame in the uncombined state and about 10 to 80 percent by weight of said discrete fibers consisting primarily of said chlorinated and/or brominated aromatic polymer.

44. A process for rendering discrete fibers non-burning which undergo burning when exposed to an ordinary match flame comprising intimately blending in physical admixture therewith discrete aromatic polyester fibers formed from the reaction of tetrabromobisphenol A, and a mixture of about 45 to 75 percent by weight isophthalic acid, and correspondingly about 55 to 25 percent by weight terephthalic acid or the ester-forming derivatives thereof having a bromine content of about 48 percent by weight and containing intimately dispersed therein about 0.1 to 10 percent by weight of an oxide of antimony based upon the weight of said aromatic polyester, with said resulting admixture as a whole being non-burning when subjected to an ordinary match flame.

45. A proess according to claim 44 wherein said discrete fibers which undergo burning when exposed to said flame are cotton.

46. A process according to claim 44 wherein said discrete fibers which undergo burning when exposed to said flame are a mixture of cotton and polyethylene terephthalate fibers.

47. A process according to claim 44 wherein said discrete fibers which undergo burning when exposed to said flame are wool.

48. A process according to claim 44 wherein said discrete fibers which undergo burning when exposed to said flame ar polyamide fibers.

49. A process according to claim 44 wherein said discrete fibers which undergo burning when exposed to said flame are cellulose triacetate fibers.

50. A process according to claim 44 wherein about 0.4 to 8 percent by weight of said oxide of antimony based upon the weight of said aromatic polyester is intimately dispersed within said discrete fibers formed from said aromatic polyester.

51. A process according to claim 44 wherein the relative proportions of the discrete fibers which are blended are such that the resulting physical admixture comprises about 20 to 90 percent by weight of said fibers which undergo burning when exposed to an ordinary match flame when in an uncombined state and about 10 to 80 percent by weight of said discrete fibers formed from said aromatic polyester and said oxide of antimony.

52. A process according to claim 44 wherein said aromatic polyester of said discrete fibers is formed by the reaction of tetrabromobisphenol A and a mixture of 45 to 75 percent by weight isophthaloyl chloride and 55 to 25 percent by weight terephthaloyl chloride.

53. An admixture of fibers in accordance with claim 1 wherein said discrete fibers of component (a) are a mixture of cotton, polyester, and polyamide fibers.

54. An admixture of fibers in accordance with claim 9 wherein said discrete fibers of component (a) are a mixture of cotton, polyester, and polyamide fibers.

55. An admixture of fibers in accordance with claim 20 wherein said discrete fibers of component (a) are a mixture of cotton, polyester, and polyamide fibers.

56. A process according to claim 44 wherein said discrete fibers which undergo burning when exposed to said flame are a mixture of cotton, polyethylene terephthalate, and polyamide fibers.

* * * * *